US005676324A

United States Patent [19]

Miyagawa

[11] Patent Number: 5,676,324

[45] Date of Patent: Oct. 14, 1997

[54] TRAVERSE DEVICE

[75] Inventor: Takashi Miyagawa, Uji, Japan

[73] Assignee: Murata Kikai Kabushiki Kaisha, Kyoto, Japan

[21] Appl. No.: 604,740

[22] Filed: Feb. 23, 1996

[30] Foreign Application Priority Data

Mar. 8, 1995 [JP] Japan ..... 7-078161

[51] Int. Cl.[6] ..... B65H 54/02; B65H 57/28; F16L 9/14; F16D 1/00

[52] U.S. Cl. ..... 242/35.5 R; 242/43 R; 242/158 R; 242/158.3; 138/146; 403/225

[58] Field of Search ..... 242/158 R, 158.3, 242/35.5 R, 43 R, 157.1, 907; 403/225, 220; 138/146, 112, 127, 143

[56] References Cited

U.S. PATENT DOCUMENTS

| | | | |
|---|---|---|---|
| 2,116,254 | 5/1938 | Welker | 403/225 |
| 3,734,139 | 5/1973 | Zafiroglu | 138/146 |
| 3,937,102 | 2/1976 | Allen | 242/43 R X |
| 4,322,062 | 3/1982 | Aleck | 403/225 X |
| 4,580,737 | 4/1986 | Schmid | 242/158 R X |
| 4,636,106 | 1/1987 | Waisbrod | 403/225 X |
| 4,791,965 | 12/1988 | Wynn | 138/146 |
| 4,878,630 | 11/1989 | Schmid | 242/35.5 R X |
| 5,499,773 | 3/1996 | Raasch et al. | 242/157.1 X |
| 5,566,721 | 10/1996 | Breese | 138/143 X |
| 5,573,344 | 11/1996 | Crane et al. | 403/225 X |

*Primary Examiner*—Michael Mansen

*Attorney, Agent, or Firm*—Armstrong, Westerman, Hattori, McLeland & Naughton

[57] ABSTRACT

A traverse device for simultaneous winding of yam packages in a spinning machine, which device can suppress the flexural vibration generated in a long rod. The traverse device incorporates a number of yarn guides 5 attached to a long, reciprocally moving rod 13 that is connected to a cam box 12 and in which a number of packages P are formed simultaneously. In particular, this device has an arrangement of a damping material 15 inside the rod 13, which is formed from a hollow pipe, and rapidly attenuates the vibration generated in the rod by the mechanical shock occurring at both ends of a reciprocal movement thereof.

3 Claims, 4 Drawing Sheets

TRAVERSE DEVICE

FIELD OF THE INVENTION

This invention relates to a traverse device used for forming a plurality of packages simultaneously and having a plurality of yarn guides attached to a reciprocally moving rod connected to a cam box, and more specifically to a device that can suppress the vibration of the rod.

BACKGROUND OF THE INVENTION

In general, textile processing machines have a plurality of processing units and package formation is carried out at each of the processing units. Furthermore, the winding part of each processing unit comprises a friction roller that is in contact with the package and a traverse device that moves the yarn across the winding width by a reciprocal motion. Concerning this winding part, there are individual winding types that convert a rotational movement into a reciprocating movement at each processing unit, and there are types that connect a rod common to each processing unit to a common cam box and carry out the reciprocating movement and winding simultaneously.

These simultaneous winding traverse devices comprise a common cam box, a reciprocally moving rod connected to said cam box, guides which guide said rod and a yarn guide that is attached to said rod at predetermined intervals.

Recently, with the development of high speed textile processing machines, the speed at which the rod on simultaneous winding traverse devices carries out a reciprocating movement has also increased. With an increase in speed of the reciprocating movement, the mechanical shock at the turn part of the reciprocating spiral groove of the cam box becomes large. Thus a light weight rod was planned. However, since it is also necessary for the rod to be rigid, a rod comprising a thin material with a large diameter and having light weight and rigidity was conceived.

However, if the rod is light weight with increased rigidity, the damping effect against the vibration decreases and the rod vibrates more. Due to this, the mechanical shock generated at the reciprocating end is transmitted to the rod and rod vibration occurs.

Previously, this vibration was soon dampened or the degree of vibration was small enough to be ignored, but on a light weight rod with increased rigidity, there is no attenuation of this vibration before the arrival of the reciprocating movement at the next end and thus a phenomenon is caused where the rod vibrates at every occurrence of the reciprocating movement. Due to this vibration, a billowing effect is caused on the surface of the package causing the yarn to easily tangle when unwinding and generally resulting in an inferior package.

SUMMARY OF THE INVENTION

In view of the above problems, it is a primary object of the present invention to provide a traverse device that can suppress the flexural vibration generated in a long rod on a traverse device for simultaneous winding.

The traverse device of the present invention that achieves the above object has a plurality of yarn guides attached to a box; carrying out a reciprocating movement and which is connected to a cam box; is a traverse device used for forming a plurality of packages simultaneously; has the above rod formed from a hollow pipe; and has damping material arranged inside that hollow pipe.

Furthermore, the aforementioned damping materials should preferably be a viscoelastic material arranged inside the aforementioned pipe as a coating. Also, the aforementioned cam box and the aforementioned rod should preferably be connected via a viscoelastic material.

Therefore even if the rod vibrates due to mechanical shock, the damping material arranged inside the hollow pipe comprising the rod demonstrates attenuation properties and quickly dampens the vibration. Further, if it is a viscoelastic material that can be coated on the inside of the pipe, a viscoelastic layer of predetermined thickness can be formed by simple execution of a coating, for example, so that it does not stand out inside the long, thin, hollow pipe. Yet further, if said cam box and said rod are connected by a viscoelastic material, the mechanical shook transmitted to the rod is reduced.

DETAILED DESCRIPTION OF THE PREFERRED EMBODIMENT

Below, the preferred embodiment of the present invention will be described with reference to the diagrams.

Figure 5:
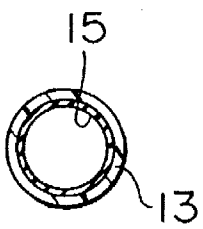
FIG. 5 is a sectional view of the rod (13).
Figure 1:
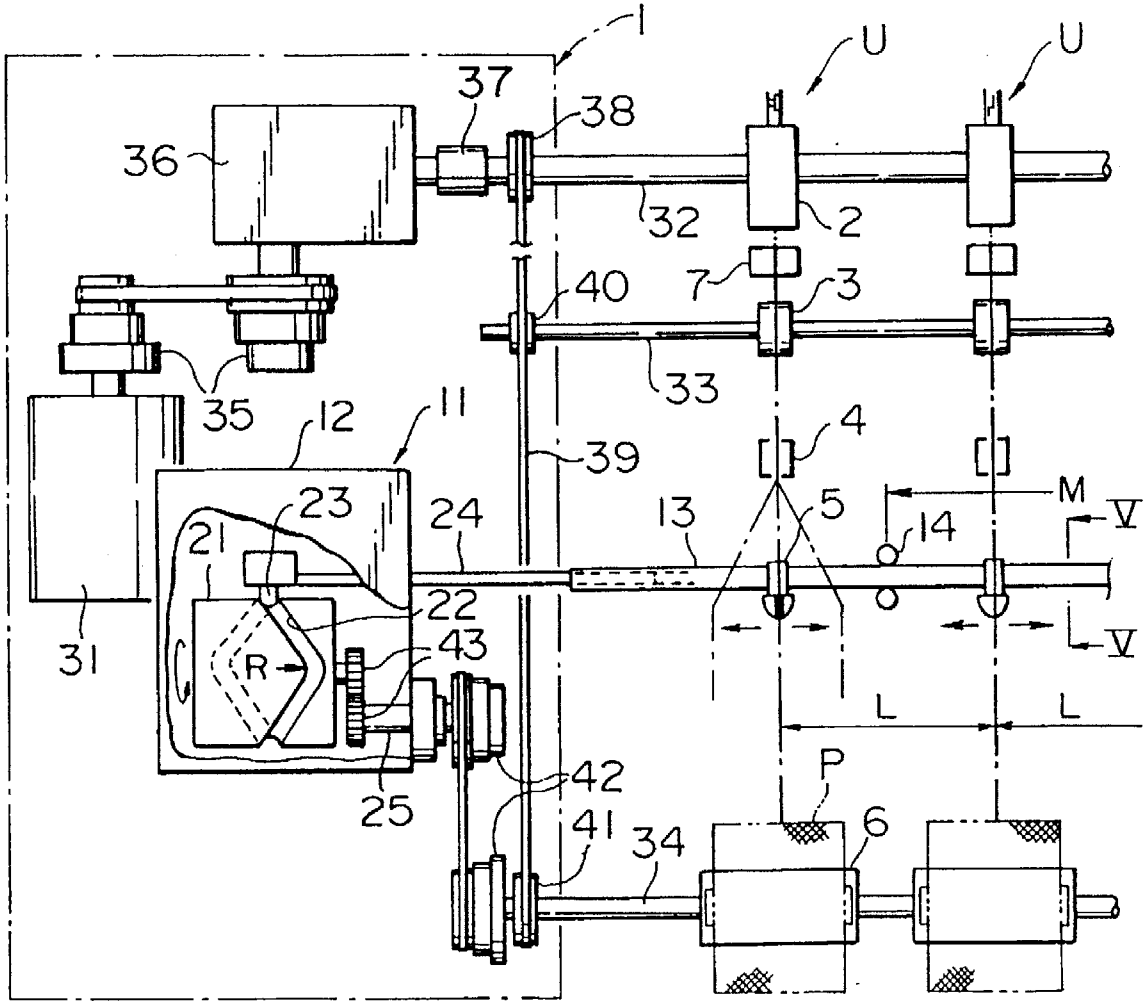
FIG. 1 shows the machine positioning of the traverse device of the present invention when applied to an innovative spinning machine.

FIG. 1 shows the machine layout of the traverse device of the present invention when applied to an innovative spinning machine. This innovative spinning machine processes silver, which is a collection of short staple fibers into a collected fiber bundle by an air jet spinning method and forms a package without yarn defects.

In FIG. 1, the innovative spinning machine has a plurality of spinning units U, U . . . arranged in a line across the drive end 1. The total number of lined up spinning units U is as much as 60 spindles. Each spinning unit U is arranged, from upstream to downstream, with a draft apparatus 2, a twist imparting device 7, a feed roller 3, a yarn clearer 4, a reciprocally moving yarn guide 5 and a friction roller 6 that is in contact with a package P. Furthermore, each of the above parts 2, 3, 5, 6 on each spinning unit U are driven simultaneously by a drive system arranged inside the drive end 1.

In particular, a traverse device 11 for simultaneous winding comprises a cam box 12 inside the drive end 1, a rod 13, a guide 14 and a yarn guide 5. In short, the yarn guides 5 of all the spinning units U, U . . . are reciprocally moved simultaneously by a common earn box 12. Due to this, the length of the rod 13 reaches 18 meters for 60 spindles.

A cam drum 21 is supported so that it rotates in the cam box 11 and a reciprocal spiral groove 22 is formed on said cam drum 21. A shoe 23 that connects with this reciprocal spiral groove 22 carries out a reciprocal movement to the left and right of the page surface with the rotation of the cam drum 21. The reciprocal movement of the shoe 23 is transmitted to output shaft 24 supported to move freely and the distal end of the output shaft 24 is connected to the rod 13. Also, rod 13 is supported by a pair of guides 14 so that it can reciprocally move. The positioning pitch M of this guide 14 is larger than the attachment pitch L of the yarn guide 5 and it is more cost advantageous to keep the number of guides 14 to as low as possible.

The above mentioned output shaft 24 uses a hollow aluminium pipe in order to make it light weight and the rod 13 also uses a hollow carbon pipe (rod) 13 in order to make it light weight. As the length of the carbon pipe (rod) 13 is usually only up to 2 meters due to the production process, by connecting by sleeves (not shown), adjacent carbon pipes (rods) a carbon pipe (rod) 13 of total length 18 meters is possible. Furthermore, the output shaft 24 is inserted into the carbon pipe (rod) 13 and the two members are interconnected.

A paint film 15 of viscoelastic material is arranged on the inside surface of this carbon pipe (rod) 13. An example of the viscoelastic material may be a water based emulsion coating with, for example, very soft rubber as the main component being allowed to dry after being painted on. A paint film can be easily formed by passing cloth, or the like, which contains the coating material through the inside of the pipe and by naturally drying the coating. As the paint film 15 is arranged inside a hollow carbon pipe (rod) 13, there is no dust attachment on the paint film 15, it is not conspicuous and there are no problems for attachment of the yarn guides 5.

If said carbon pipe (rod) 13 starts flexurally vibrating with the guide 14 as a node due to the mechanical shock, the paint film 15 of the viscoelastic material carries out a repetitive telescopic and compressive deformation, absorbing the vibration energy and has an effect of rapidly attenuating the vibration.

It is preferable for the turn part R (the radius of curvature) of the reciprocating spiral groove 22 to be as small as possible in order to prevent saddlebag of the package, and 25 mm is an example of a small R. Consequently, as there is generation of mechanical shock by the rapid speed change at both ends of the reciprocating movement of the rod 13, an exciting force is generated in the output shaft 24 and this exciting force is transmitted to the rod 13.

The rod 13 affected by this exciting force starts a flexural vibration with guides 14 as nodes. However, as the aforementioned viscoelastic paint film 15 absorbs the energy of this flexural vibration and converts it to heat, the flexural vibration of the rod 13 is rapidly attenuated and the flexural vibration disappears before reaching the next end of the reciprocating movement.

Recently, in order to make the rod 13 light weight, there has been a tendency to reduce the thickness of the rod 13. By reducing the thickness, the rigidity of the rod 13 is reduced, thus by increasing the diameter of the rod 13, both lightness and high rigidity can be achieved. However, a light rigid rod 13 easily starts vibrating at a comparatively high frequency.

Also, there has been a tendency to reduce the number of guides 14 of the rod 13. Consequently, the rod 13 which is vibrating with guide 14 as a node tends not to stop vibrating.

However, by using a rod 13 having the aforementioned viscoelastic paint film, the vibration can be rapidly attenuated making a light rod 13 possible and allowing for reduction of the number of guides 14.

For a damping material arranged inside the rod 13, instead of the aforementioned viscoelastic coating material, the arrangement of a plastic sheet of low melting point inserted into the pipe and melted by heating to form a resinous layer, or a sponge inserted into the rod 13 can also be used. Furthermore, the paint film 15 inside the rod 13 should preferably be spread over the entire length of the rod 13 but even in the case of multiple tube connections, quite a great attenuation effect can be obtained from just one pipe. In this case, as the level of flexural vibration is greater towards the source side (driving device side) of the rod 13, it is possible to coat the one pipe of the source side.

Figure 2:
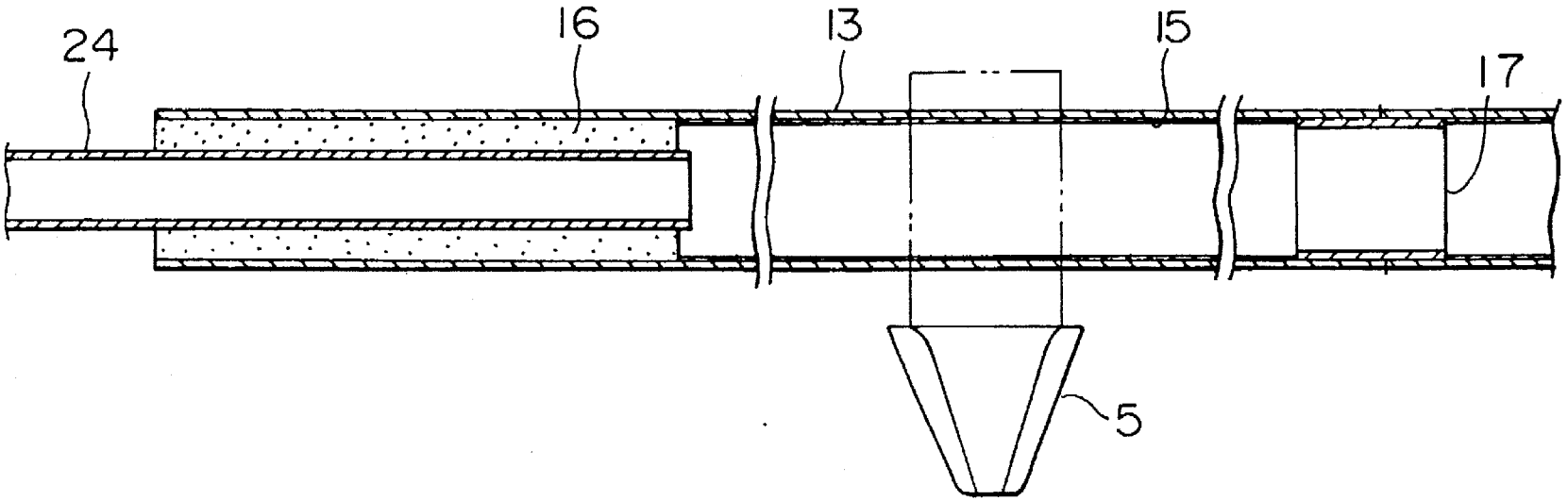
FIG. 2 is a section view showing the connection between the cam box and the rod.

In addition, it is advantageous to prevent transmission of the impact force from the output shaft 24 to the rod 13 by as much as possible. In order to do this, it is preferable to introduce a viscoelastic material 16 between the outer surface of the output shaft 24 and the inner surface of the rod 13 as shown in FIG. 2. A thickened coating, as described above, can be used for this viscoelastic material 16. Attenuation of the impact force via the viscoelastic material 16 alone is sufficient to reduce the exciting force against the rod 13. It should be noted that the viscoelastic material 16 generates heat due to the absorption of the mechanical shock. In order to increase the area of radiation of this heat, it is preferable to increase the length of the section of the viscoelastic material 16 to, for example, over 1 meter.

It should be noted that number 17 is a sleeve for connecting the rods 13 and is fixed by adhesive to the rod 13. In the diagrammatical example, the paint film 15 inside the rod 13 is arranged everywhere except the sleeve 17 part. Also, the yarn guide 5 is attached to the outer surface of the rod 13 by an appropriate fixing means.

Returning to FIG. 1, the drive end 1 rotates a first shaft 32, second shaft 33 and third shaft 34 by a single motor 31 and is a structure that makes the rod 13 carry out a reciprocating movement. The motor 31 rotates the first shaft 32 used for the draft device 2 via a pair of three step pulleys 35, a speed reduction gear 36 and cup ring 37. The spinning speed can be changed to three different levels by the changing of the three step pulley 35.

The pulley 40 into which the second shaft 33 for the feed roller 3 is inserted and furthermore the pulley 41 into which third shaft 34 used for the friction roller 6 is inserted are rotated by the belt 39 attached to the pulley 38 into which first shaft 32 is inserted. The input shaft 25 of the cam box 12 is rotated by a pair of three step pulleys 42 into which the end of the third shaft 34 and the end of the input shaft 25 are inserted respectively.

The input shaft 25 rotates the cam drum 21 via the pair of gears 43. Thus the output shaft 24 reciprocally moves as described above via the shoe 23. The winding angle of the package P can be changed by changing the three step pulley 42.

It should be noted that the drive system of the above mentioned drive end is but one example and can comprise gears instead of pulleys, for example.

Next, an experimental example will be described.

Figure 3:
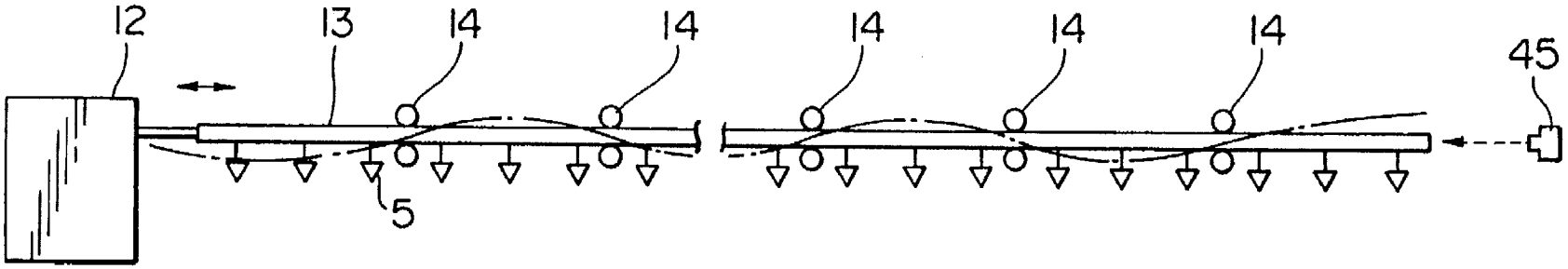
FIG. 3 shows the state of the flexural vibration of the rod.

The traverse device was used in an experiment, as shown in FIG. 3. The reciprocal movement of the cam box 12 was at a rate of 360 double strokes/minute and was set to nearly double the normal innovative spinning machine rate of 200 double strokes/minute. Eighteen meters of total length of carbon pipe (rod) 13 were used with 10 joints, an outer diameter of 20 mm and a thickness of 0.5 mm.

Also, there were a total of 17 guides 14, the carbon pipe (rod) 13 was divided into 18 sections and there were a total of 60 yarn guides 5. Furthermore, a distance sensor 45 arranged on the tip of the carbon pipe (rod) 13 measured the state of the reciprocal movement and the results are shown in FIGS. 4A and 4B.

Figure 4A:
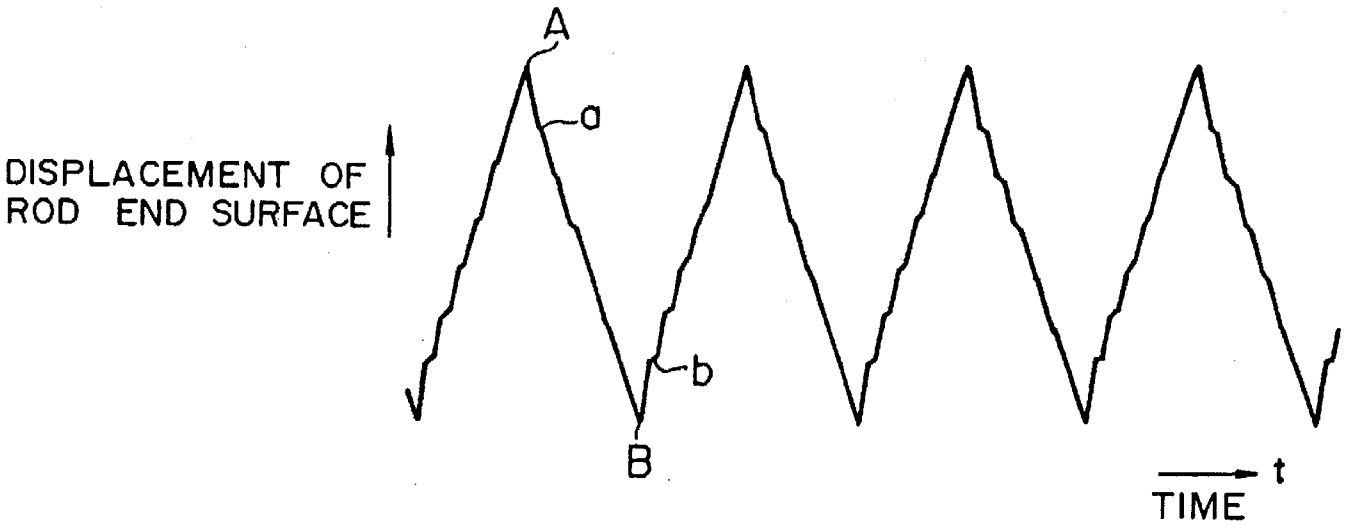
FIGS. 4A and 4B show attenuated states of the flexural vibration of the rod.

FIG. 4A shows the state of the reciprocating movement when a coating type damping material is coated to a thickness of 500 microns on the inside of the carbon pipe (rod) 13 excluding the joint parts. Flexural vibration "a" is generated by the mechanical shock at one end "A" of the reciprocating movement but is quickly attenuated and is almost completely extinguished by the third vibration. Also, the flexural vibration "b" generated by the mechanical shock at the other end "B" of the reciprocating movement is rapidly attenuated in the same way as flexural vibration "a".

The yarn guide also vibrates due to the flexural vibration of the carbon pipe (rod) 13 and slight steps which are in sychronicity with the flexural vibrations "a", "b" may be produced in the package but these steps are slight and do not interfere with the practical usage.

Figure 4B:
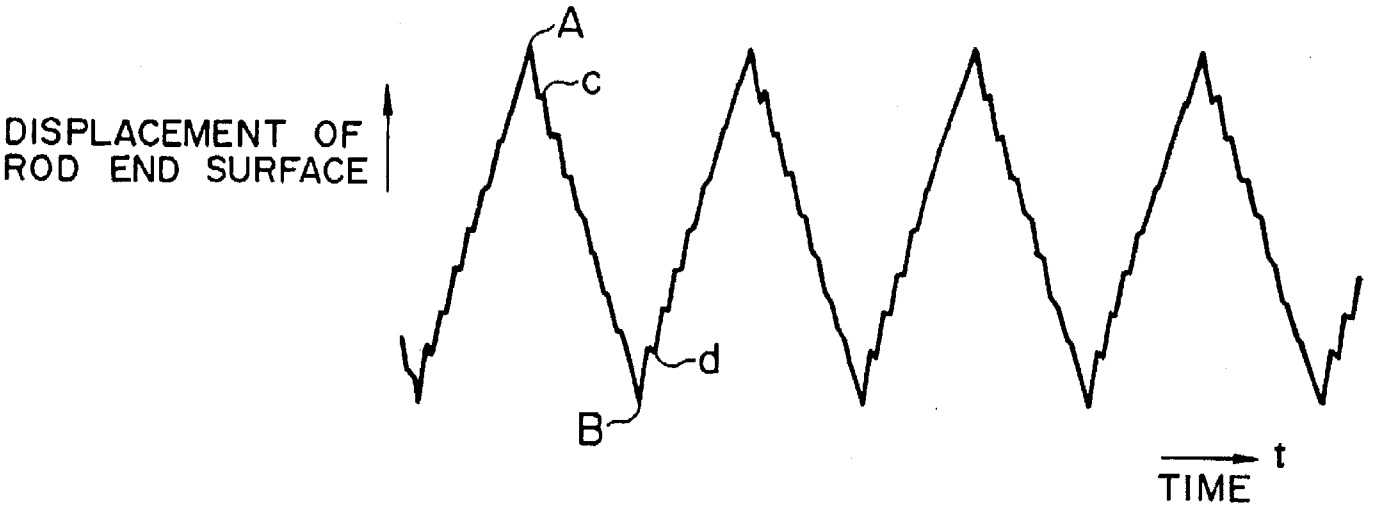

FIG. 4B shows the state of the reciprocating movement when no damping material is arranged inside the carbon pipe (rod) 13. The flexural vibration generated at one end "A" of the reciprocating movement is only attenuated to a small degree, it continues to the other end "B" of the reciprocating movement.

Furthermore, the flexural vibration "c" reaches the other end "B" of the reciprocating movement before it has disappeared and, once again, here flexural vibration "d" is generated. In short, a flexural vibration is generated during the entire duration of the reciprocating movement and leads to large steps in the package synchronous with the flexural vibration "c", "d". As the step height is large, hindrance to package unwinding is caused.

This phenomenon is caused when the speed of the reciprocating movement of the traverse device is higher than the normal 200 double stroke/minute. As a result, any increase in the speed of innovative spinning machines is obstructed. However, by using the traverse device of the present invention, this obstruction can be removed.

It should be noted that an innovative spinning machine was used as a suitable example for the above traverse device but any simultaneous winding type textile processing machine can also be applied. For example, on a double twister, the processed yarn from a double twisted spindle can be wound simultaneously by the above mentioned traverse device. In this case, the positioning is from the spindle on the lower side to the feed roller, traverse device and friction roller on the upper side and forms a similar structure only upside-down when compared to that in FIG. 1.

The processing speed of a double twister is slow compared to the spinning speed of the innovative spinning machine, but even on the traverse device of a double twister, there is a tendency to reduce the number of guides that freely support the rod in order to reduce the cost. By doing so, the natural vibration frequency of the rod changes and a flexural vibration which is difficult to attenuate maybe generated. The traverse device of the present invention is effective in application in this case.

The aforementioned embodiment describes the coating of a viscoelastic paint film on the inside surface of a hollow pipe but, in this ease, a construction where the inside of the hollow pipe is scaled in order to prevent hardening or heat production of the damping material.

Next, other embodiments will be described.

A second embodiment is the closing of both ends of the aforementioned hollow pipe, thus producing a closed space inside the pipe and the insertion of a fluid material into that space. Water, being the most freely available fluid medium, can be used. It should be noted that the amount of fluid inserted is an amount where the fluid can freely move inside the pipe in response to the reciprocal movement of the hollow pipe and it is not preferable to fill the inside of the pipe completely with fluid.

In the case of insertion of a fluid in this way, as the fluid moves after generation of a vibration by the reciprocal movement of the pipe, the vibration can be effectively suppressed.

A further third embodiment is a structure comprising the connection of a plurality of hollow pipes, the introduction of sleeves at those joints and the filling of those sleeves with viscoelastic material. A suitable gel type material, such as a gel-type urethane rubber, can fill the sleeves as a viscoelastic material in this case. When the pipe vibrates, an attenuation effect is produced by the delayed movement of this viscoelastic material. Also, arrangement of floating aluminium tubes inside the viscoelastic material inside the sleeves is possible and the attenuation effects are further increased.

A damping material is arranged inside a hollow pipe being a rod which is reciprocally moving on the traverse device of the present invention, as the flexural vibration of the rod due to the mechanical shock transmitted by the reciprocally moving end to the rod, is rapidly attenuated, the traverse device can achieve high speeds and the cost can be reduced by a reduction in the number of rod guides of the traverse device.

What is claimed is:

1. A traverse device for positioning intermediate yarn processing means and package take-up means for simultaneously forming a plurality of packages, comprising:

a drive apparatus for producing reciprocating motion;

a rod in the form of a hollow pipe containing a plurality of axially spaced yarn guides therealong;

means for connecting said drive apparatus to said rod for imparting reciprocating motion thereto; and a thin film coating of viscoelastic material applied to the inside surface of said hollow pipe.

2. A traverse device as claimed in claim 1, wherein an output shaft of said drive apparatus and said rod are connected via a viscoelastic material.

3. A traverse device, as claimed in claim 2, in which said drive apparatus has an output shaft received in an adjacent end of said hollow pipe in concentrically spaced relation from the inside surface of said hollow pipe, and the space between said drive apparatus output shaft and said inside surface of said hollow pipe is substantially filled with a body of viscoelastic material.

* * * * *